US007621783B1

(12) United States Patent
Lai

(10) Patent No.: US 7,621,783 B1
(45) Date of Patent: Nov. 24, 2009

(54) CARD CONNECTOR CAPABLE OF AVOIDING MULTIPLE FALSE ACTIONS OF CARD

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 12/320,378

(22) Filed: Jan. 26, 2009

(30) Foreign Application Priority Data

Nov. 10, 2008 (TW) ..... 97220148 U

(51) Int. Cl.
*H01R 24/00* (2006.01)

(52) U.S. Cl. ..... 439/630

(58) Field of Classification Search ..... 439/630, 439/326, 376, 341
See application file for complete search history.

(56) References Cited

U.S. PATENT DOCUMENTS 5,839,913 A * 11/1998 Fumikura ..... 439/326
6,095,827 A * 8/2000 Dutkowsky et al. ..... 439/83
6,607,395 B2 * 8/2003 Hashimoto ..... 439/326
6,821,144 B2 * 11/2004 Choy ..... 439/541.5
7,118,420 B1 10/2006 Lai et al.

* cited by examiner

*Primary Examiner*—Neil Abrams
*Assistant Examiner*—Phuong Nguyen
(74) *Attorney, Agent, or Firm*—Bacon & Thomas, PLLC

(57) ABSTRACT

A card connector capable of avoiding multiple false actions of an inserted card includes a base frame; a cover member jointly form a card chamber with thee frame; a plurality of terminals mounted to the base frame, extending into the card chamber; and two adjacent movable spacers including a left movable spacer and a right movable spacer, which are pivotably attached to the base frame. The left movable spacer includes a left guide slope extending rearward toward a center of the base frame from a left front side thereof. The right movable spacer includes a right guide slope extending rearward toward a center of the base frame from a right front side thereof. The left movable spacer includes a left bevel formed at a front left edge thereof. The right movable spacer includes a right bevel formed at a front right edge thereof.

9 Claims, 12 Drawing Sheets

CARD CONNECTOR CAPABLE OF AVOIDING MULTIPLE FALSE ACTIONS OF CARD

BACKGROUND OF THE INVENTION

1. Field of the Invention

The present invention relates generally to electronic card connectors, and more particularly, to an electronic card connector capable of avoiding multiple false actions of an inserted card.

2. Description of the Related Art

U.S. Pat. No. 7,118,420 disclosed a dual-slot card connector capable of avoiding erroneous insertion of two cards at a time, as filed by the applicant of the present invention. The card connector includes a base frame, two (upper and lower) card slots, and a movable plate located in the base frame. When a card is inserted into the upper card slot of the card connector, the movable plate is moved downward to block the lower card slot in such a way that none of any other card can enter the lower card slot. When a card is inserted into the lower card slot, the movable plate is moved upward to block the upper card slot in such a way that none of any card can enter the upper card slot. In this way, only one card can enter the card connector at a time.

However, the two card slots enlarge the vertical distance of the entrance of the card connector, such that the inserted card is subject to false action. For example, if it is intended to insert a card into the lower card slot, when the card is inserted askew, the front edge of the card probably interferes with the upper and lower card slots to work on the movable plate and then the movable plate is forced to pivot downward; in this way, the card is guided by the movable plate to erroneously enter the upper card slot. Under the circumstances, the movable plate must have a fool-proof mechanism to avoid the false action of the card, and then the card connector still fails to be structurally effectively simplified.

SUMMARY OF THE INVENTION

The primary objective of the present invention is to provide a card connector, which simply designed to allow insertion of only one single card at a time and to avoid multiple false actions of the card.

The foregoing objective of the present invention is attained by the card connector composed of a base frame, a cover member, a plurality of terminals, and two movable spacers. The base frame includes at least two card slots. The cover member is mounted onto the base frame. The cover member and the base frame jointly form a card chamber therebetween. An entrance is defined between respective front ends of the cover member and the base frame. The terminals are mounted to the base frame, extending into the card chamber. The two movable spacers are adjacent to each other, including a left movable spacer and a right movable spacer, which are pivotably attached to the base frame and located in the card chamber. The left movable spacer includes a left guide slope extending rearward toward a center of the base frame from a left front side thereof. The right movable spacer includes a right guide slope extending rearward toward a center of the base frame from a right front side thereof. The left movable spacer includes a left bevel extending downward and forward from a front left edge thereof. The right movable spacer includes a right bevel extending downward and forward from a front right edge thereof. Accordingly, the two movable spacers can enable the present invention to allow entry of only one single card at a time and to avoid multiple false actions of the card.

DETAILED DESCRIPTION OF PREFERRED EMBODIMENTS

Figure 1:
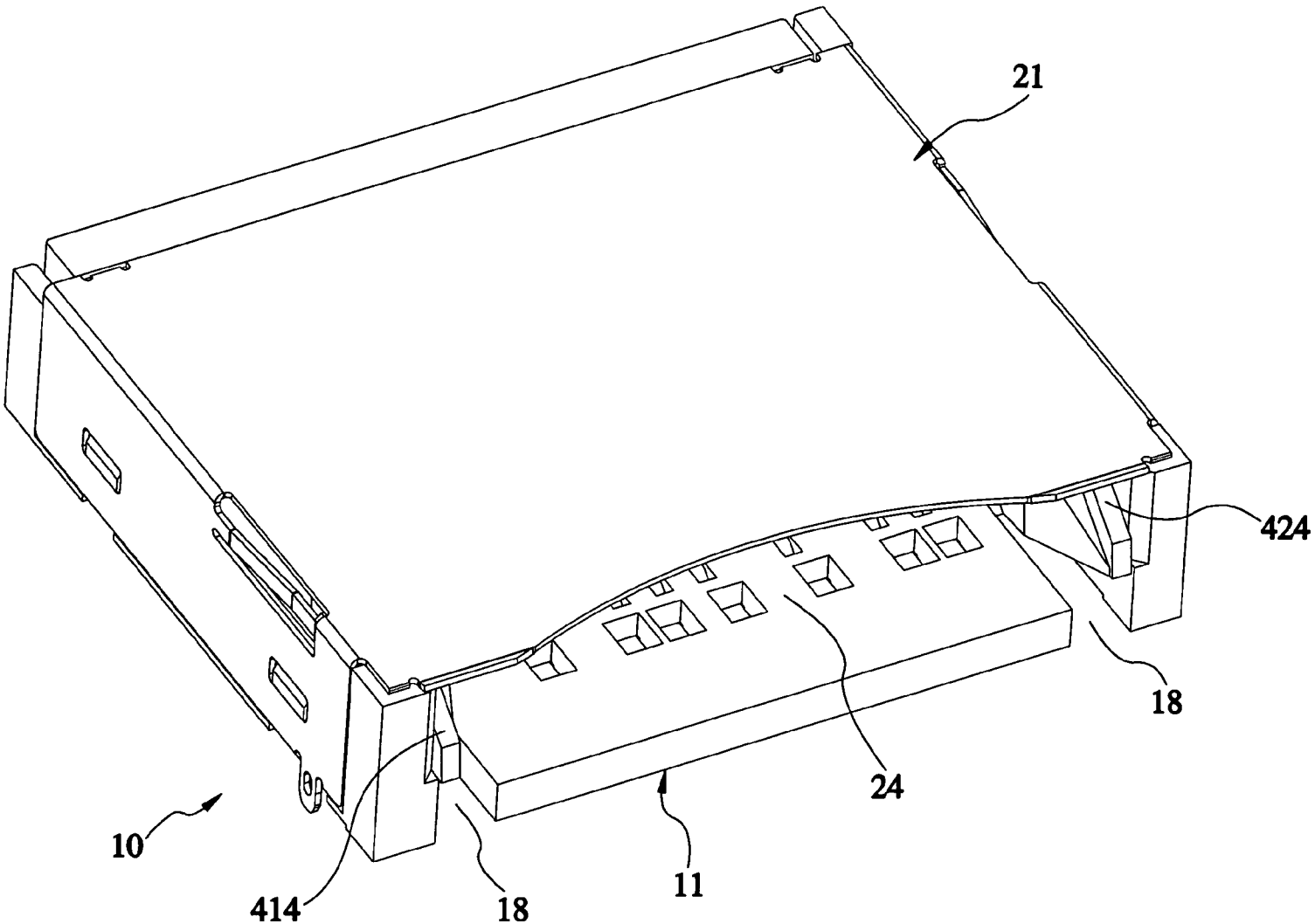
FIG. 1 is a perspective view of a preferred embodiment of the present invention.
Figure 2:
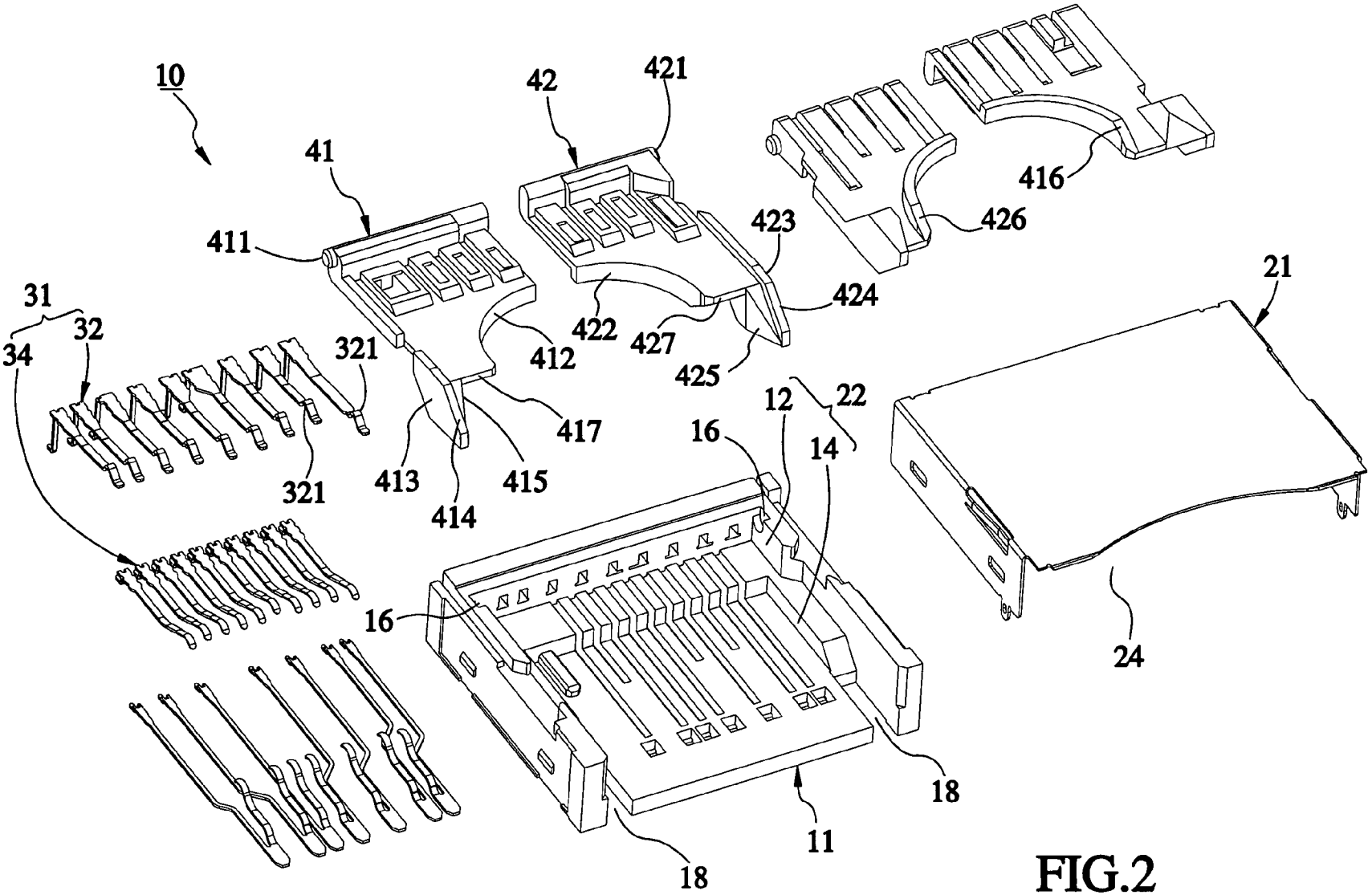
FIG. 2 is an exploded view of the preferred embodiment of the present invention, plus a bottom view of two movable spacers.
Figure 3:
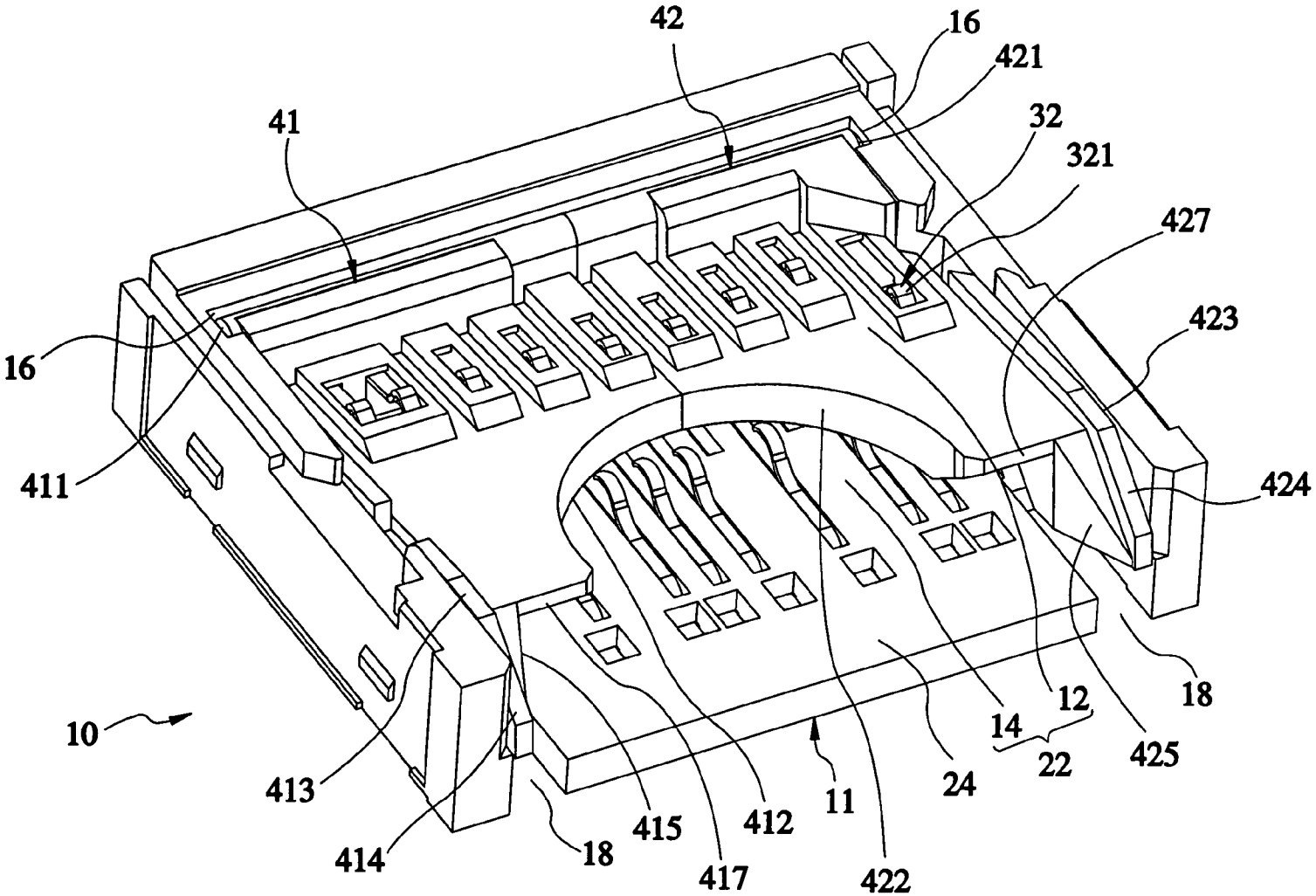
FIG. 3 is a perspective view of the preferred embodiment of the present invention whose cover member is removed therefrom.

Referring to FIGS. 1-3, a card connector 10 capable of avoiding multiple false actions of a card in accordance with a preferred embodiment of the present invention is composed of a base frame 11, a cover member 21, a plurality of terminals 31, and two movable spacers 41 and 42.

The base frame 11 includes at least two card slots 12 and 14 formed therein, two pivot cavities 16 formed at two inner rear sides thereof, and two hollow portions 18 formed at two inner front sides thereof. In this embodiment, one of the two card slots is the upper card slot 12 for receiving a relatively wider card, like SD card 91 shown in FIG. 4, and the other is the lower card slot 14 for receiving a relatively narrower card, like an MS-Duo card 92 shown in FIG. 7. The upper card slot 12 is located above the lower card slot 14.

The cover member 21 is mounted onto the base frame 11, and in this way, a card chamber 22 is formed between the base frame 11 and the cover member 21 and an entrance is jointly defined by respective front ends of the base frame 11 and the cover member 21. In this embodiment, the card chamber 22 is formed of the two card slots 12 and 14.

The terminals 31 are mounted to the base frame 11, extending into the card chamber 22. The terminals 31 are divided into two groups, i.e. an upper terminal set 32 and a lower terminal set 34, located in the two slots 12 and 14 in turn respectively. The lower terminal set 34 is located below the two movable spacers 41 and 42. The upper terminal set 32 is located above the lower terminal set 34, being stopped against bottom sides of the two movable spacers 41 and 42. Each of the terminals in the upper terminal set 32 has a contact portion 321 running upward through the bottom sides and top sides of the movable spacers 41 and 42 and then exposed above the movable spacers 41 and 42 for contact with an inserted card. It is to be noted that there is another terminal set having no referral number and this terminal set will not be illustrated because its action manner is identical to that of the lower terminal set 34.

The two movable members are adjacent to each other and defined as a left movable member 41 and a right movable member 42. The two movable members 41 and 42 each includes a pivot piece 411 (421) formed at a rear edge thereof and pivotably attached to the corresponding pivot cavity 16 and are located in the card chamber 22; in this way, respective front edges of the two movable members 41 and 42 are movable upward and downward. Besides, the two movable spacers 41 and 42 are supported by the upper terminal set 32 to slightly hike to enable their front edges to be located at an upper level of the card chamber 22. The left movable spacer 41 includes a left guide slope 412 extending rearward toward a center of the base frame 11 from a front left side thereof. The right movable spacer 42 includes a right guide slope 422 extending rearward toward the center of the base frame 11 from a front right side thereof. In this embodiment, the left and right guide slopes 412 and 422 jointly constitute a semicircle arc. The left movable spacer 41 includes a left front arm 413 formed at a left side of a front edge thereof and having a left bevel 414 extending downward and forward. The right movable spacer 42 includes a right front arm 423 formed at a right side of the front edge thereof and having a right bevel 424 extending downward and forward. The left front arm 413 corresponds to one of the hollow portions 18 and the right front arm 423 corresponds to the other hollow portion 18. When the two movable spacers 41 and 42 pivot downward down to a lowest point, the left and right front arms 413 and 423 are engaged with the two hollow portions 18 respectively. Besides, each of the left and right front arms 413 and 423 includes an inclined guide portion 415(425) for guiding an thereof for guiding an inserted card. The two inclined guide portions 415 and 425 faces each other. Furthermore, each of the left and right guide slopes 412 and 422 includes a guide bevel 416(426) formed at a lower front edge thereof. The left movable spacer 41 further includes a stopper 417 formed at a front edge thereof and located at a left side of the left guide slope 412. The right movable spacer 42 further includes a stopper 427 formed at a front edge thereof and located at a right side of the right guide slope 422. FIG. 2 further illustrates a bottom view of the two movable spacers 41 and 42.

Referring to FIG. 3, when none of any card is inserted into the present invention, the two movable spacers 41 and 42 are supported by the upper terminal set 32 to enable their front edges thereof to hike.

Figure 4:
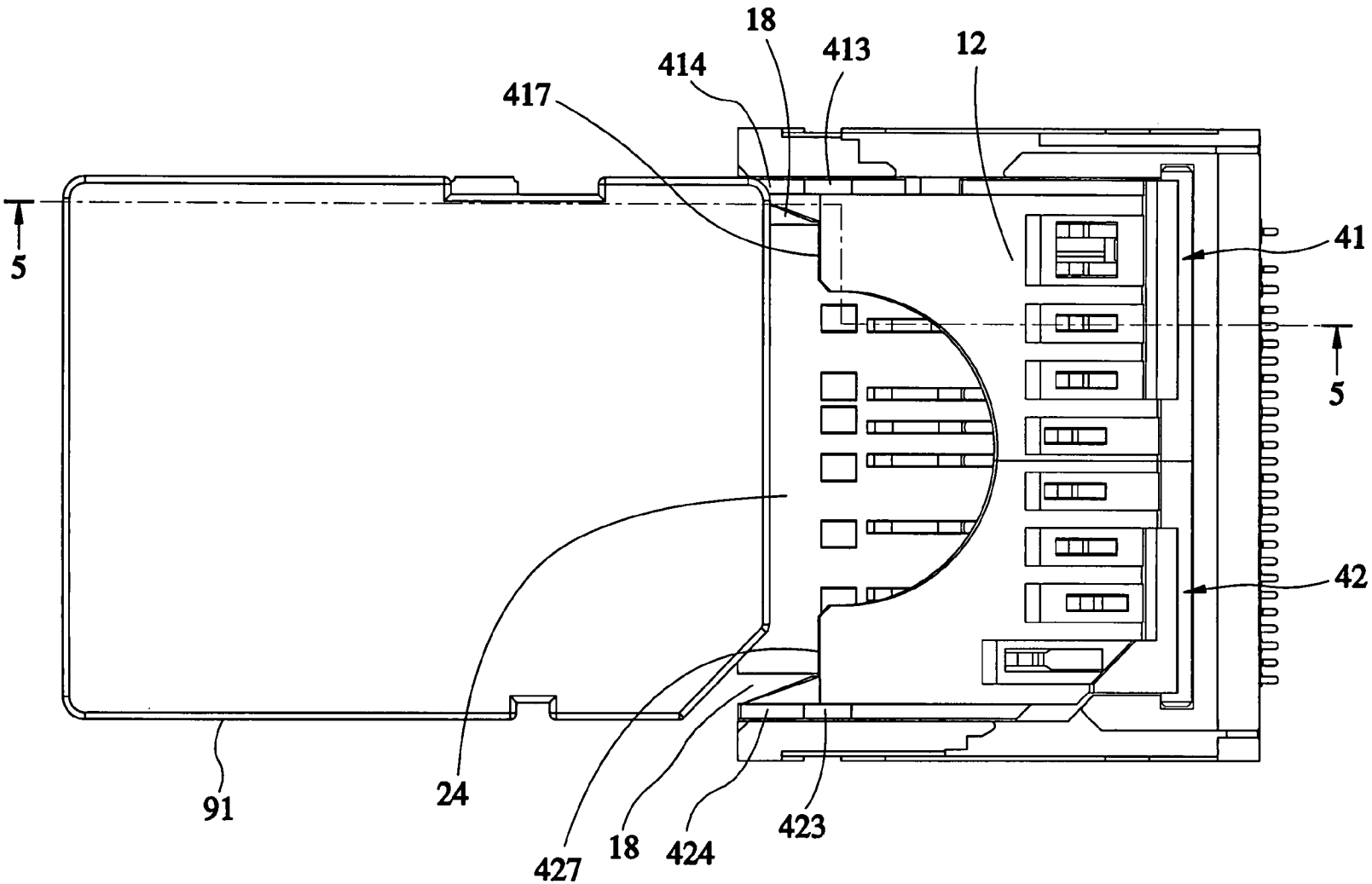
FIG. 4 is a schematic view of the preferred embodiment of the present invention in operation, illustrating that an SD card is being inserted.
Figure 5:
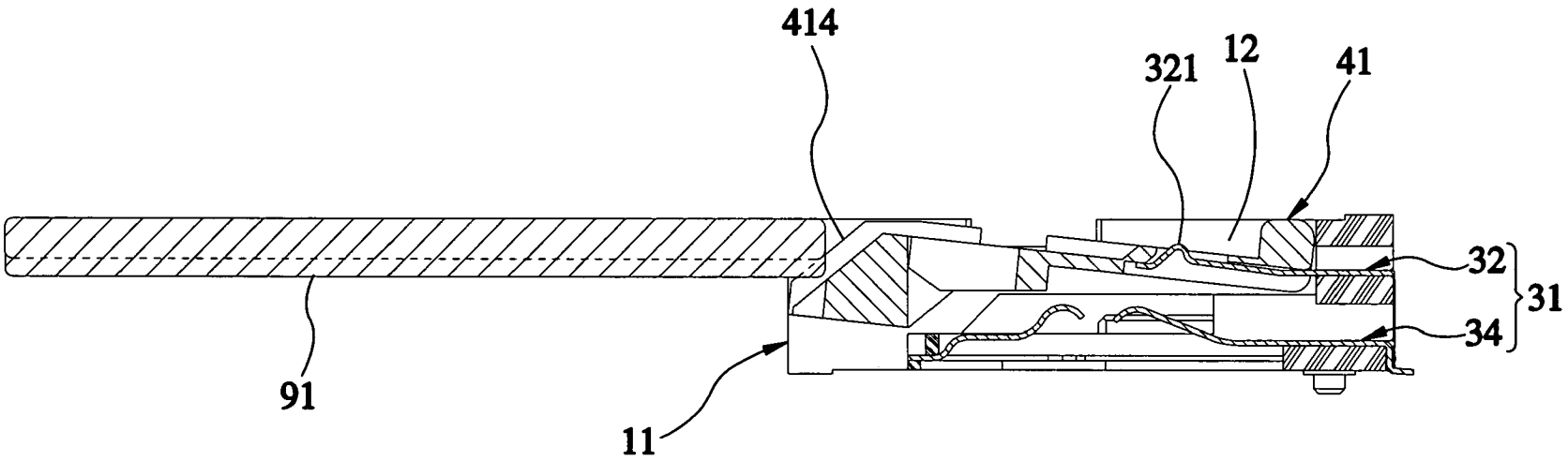
FIG. 5 is a sectional view taken from a line 5-5 indicated in FIG. 4.
Figure 6:
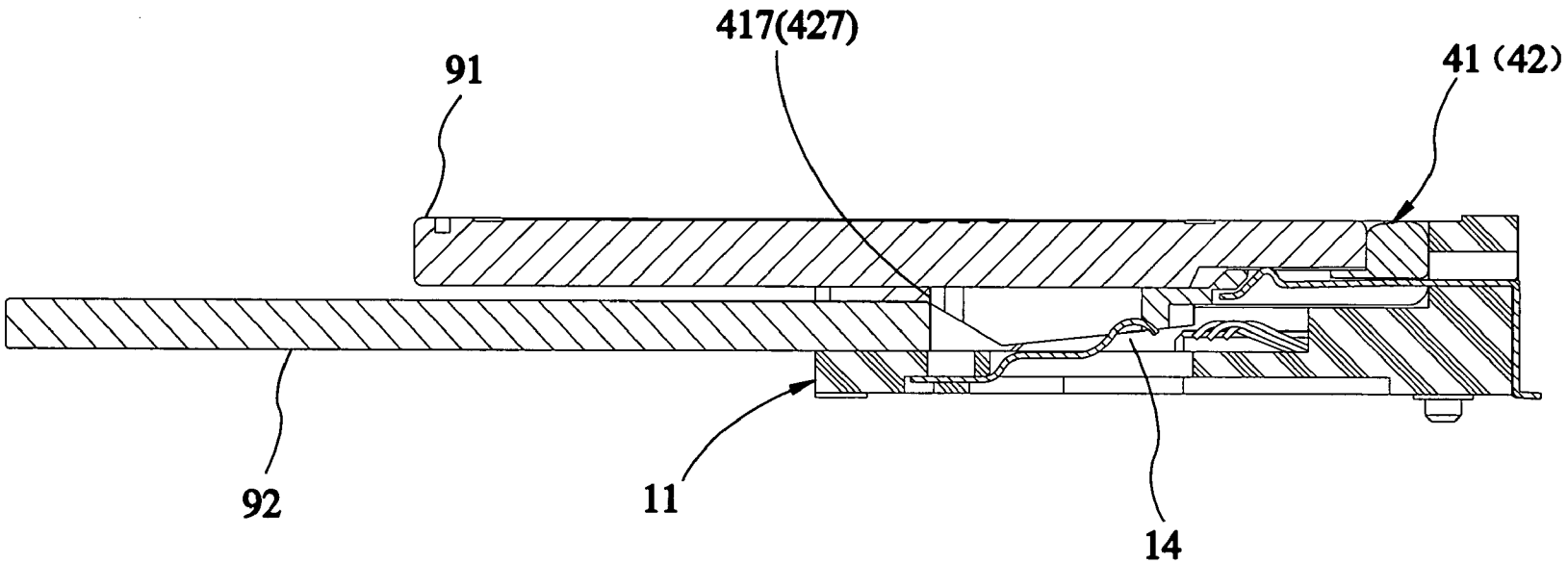
FIG. 6 is a schematic view of the preferred embodiment of the present invention in operation, illustrating that an MS-Duo card cannot be inserted after the SD card is inserted.

Referring to FIGS. 4-5, during the insertion of the SD card 91 into the card connector 10, a front edge of the SD card 91 first touches the left and right bevels 414 and 424 and then presses and forces the front edges of the two movable spacers 41 and 42 to pivot downward; meanwhile, the right and left front arms 413 and 423 are engaged with the hollow portions 18 respectively, and then the SD card 91 can be moved further to enter the upper card slot 12. As shown in FIG. 6, after the SD card 91 is inserted, the lower card slot 14 is blocked by the two movable spacers 41 and 42 and thus the MS-Duo card 92 is stopped by the two stoppers 417 and 427 from entering the lower card slot 14.

Figure 7:
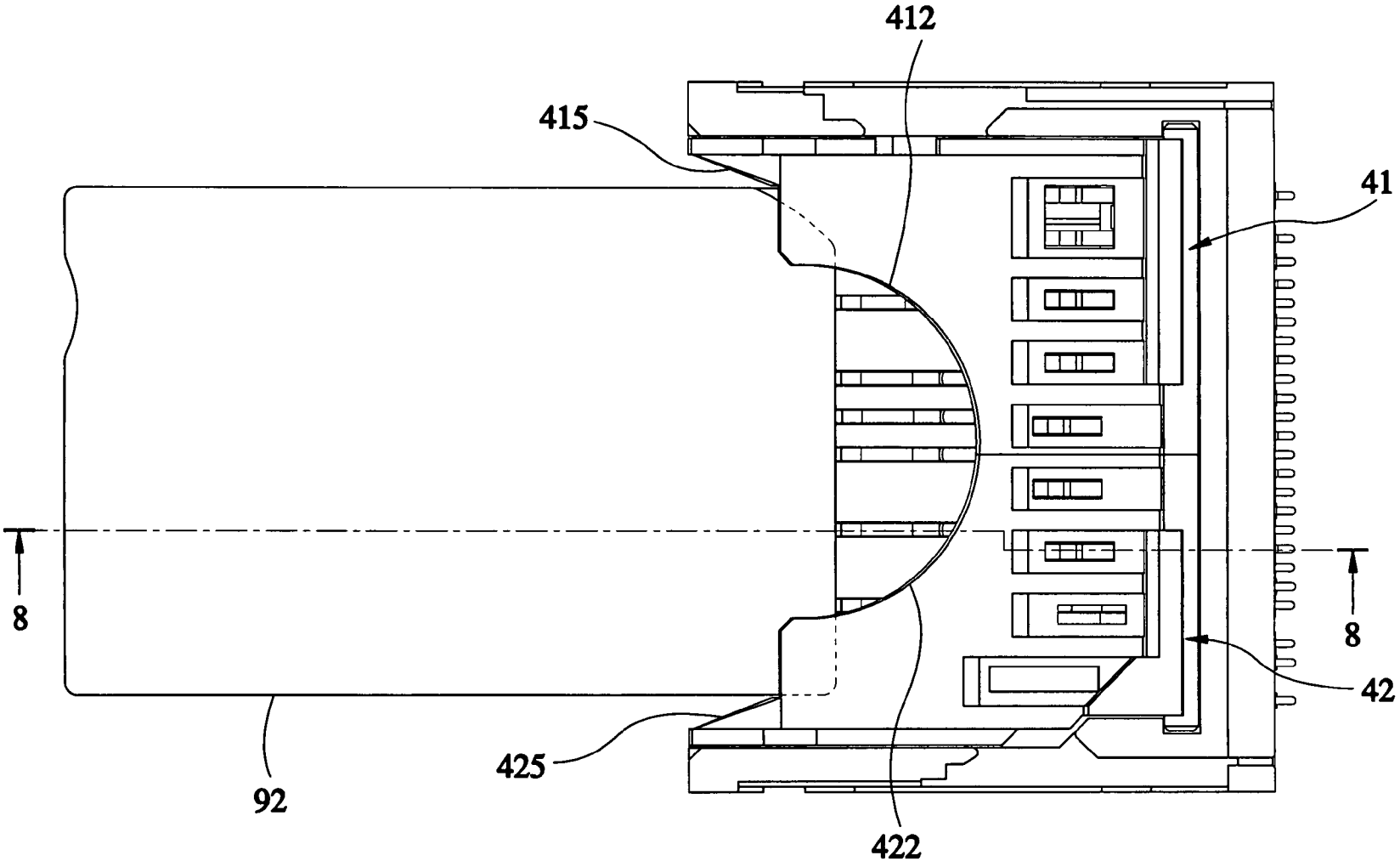
FIG. 7 is another schematic view of the preferred embodiment of the present invention in operation, illustrating that an MS-Duo card is being inserted.
Figure 8:
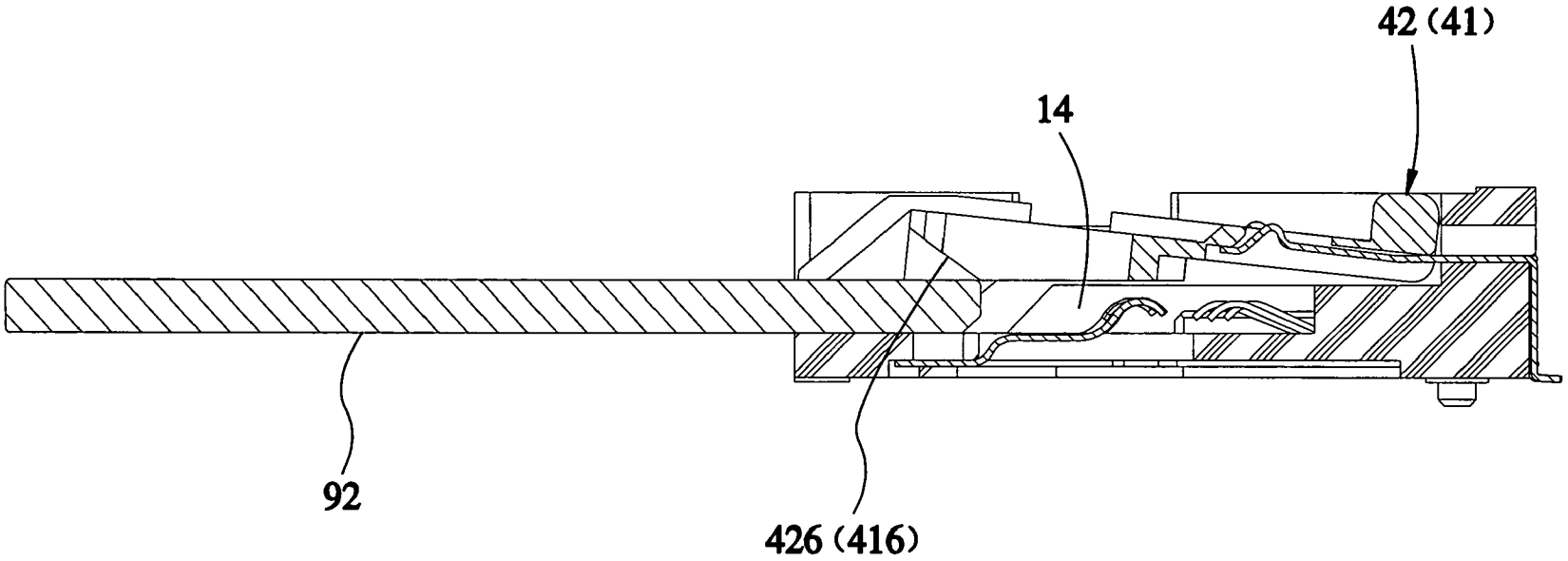
FIG. 8 is a sectional view taken from a line 8-8 indicated in FIG. 7.
Figure 9:
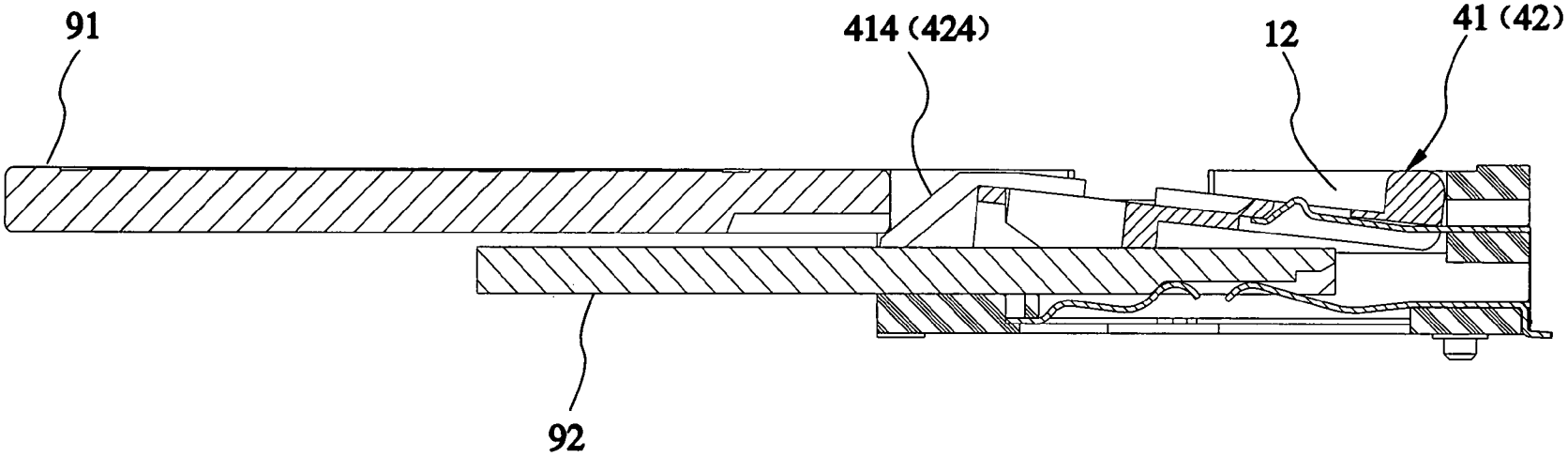
FIG. 9 is another schematic view of the preferred embodiment of the present invention in operation, illustrating that the SD card cannot be inserted after the MS-Duo card is inserted.

Referring to FIGS. 7-8, during the insertion of the MS-Duo card 92 into the card connector 10, the two movable spacers 41 and 42 hike, so a front edge of the MS-Duo card 92 first touches the two inclined guide portions 415 and 425 and the guide bevels 416 and 426 and then enters what is under the two movable spacers 41 and 42, and finally enters the lower card slot. As shown in FIG. 9, after the MS-Duo card 92 is inserted, the upper card slot 12 is blocked by the two movable spacers 41 and 42; when the SD card 91 is being inserted, it though works on the left and right bevels 414 and 424, but the SD card 91 still cannot enter the card chamber 22 because the MS-Duo card 92 blocks the two movable spacers 41 and 42 and fails to force the two movable spacers 41 and 42 to pivot downward.

Figure 10:
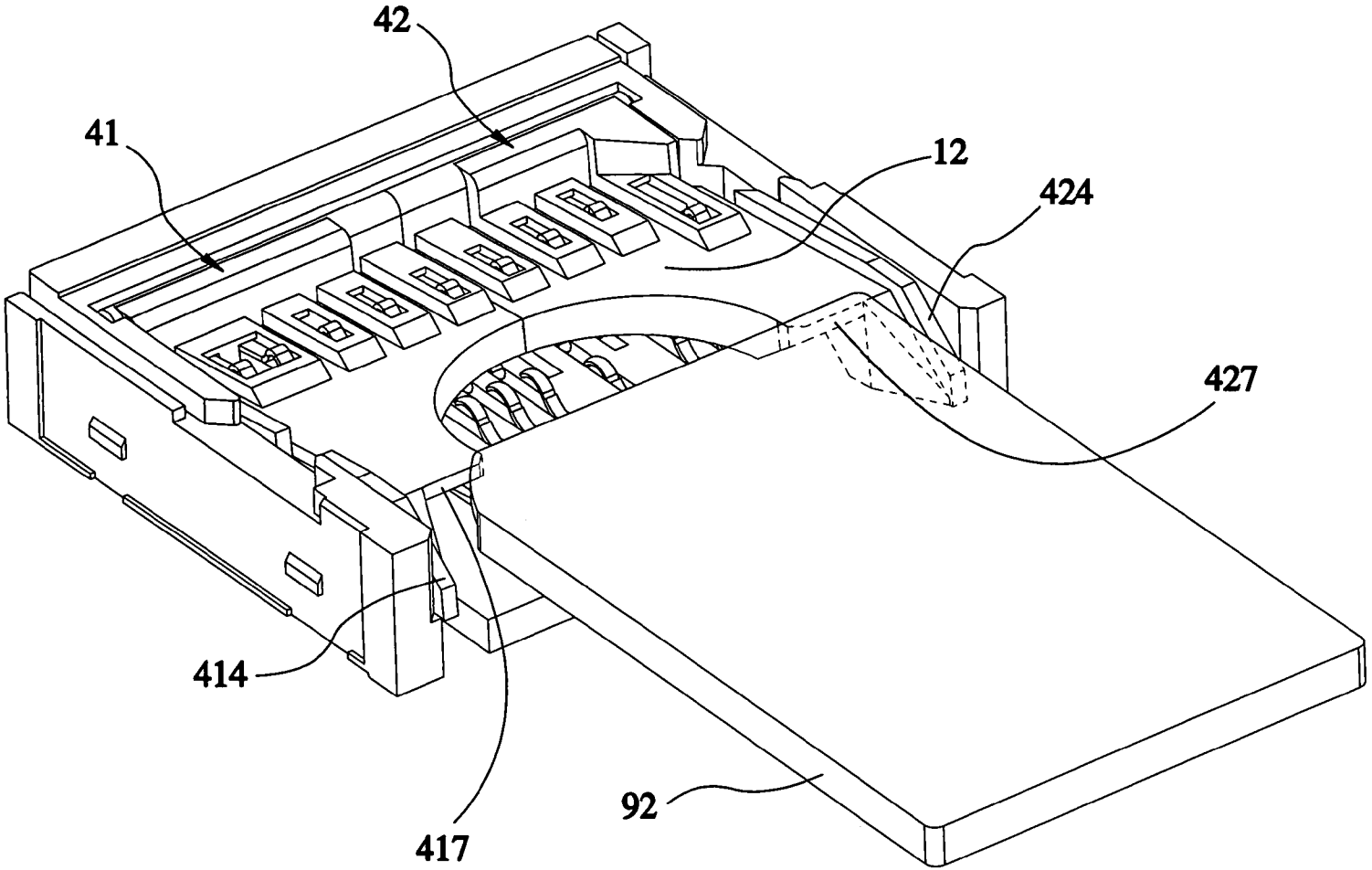
FIG. 10 is a schematic view of the preferred embodiment of the present invention in operation when a false action happens, illustrating that the MS-Duo card is stopped from entering the upper card slot.

Referring to FIG. 10, while none of any card is inserted, even if it is intended to insert the MS-Duo card 92 into the card chamber 22, the MS-Duo card 92 will be stopped by the two stoppers 417 and 427 to fail to enter the card chamber 22 because it does not work on the left and right bevels 414 and 424 and then fails to force the two movable spacers 41 and 42 to pivot downward.

Figure 11:
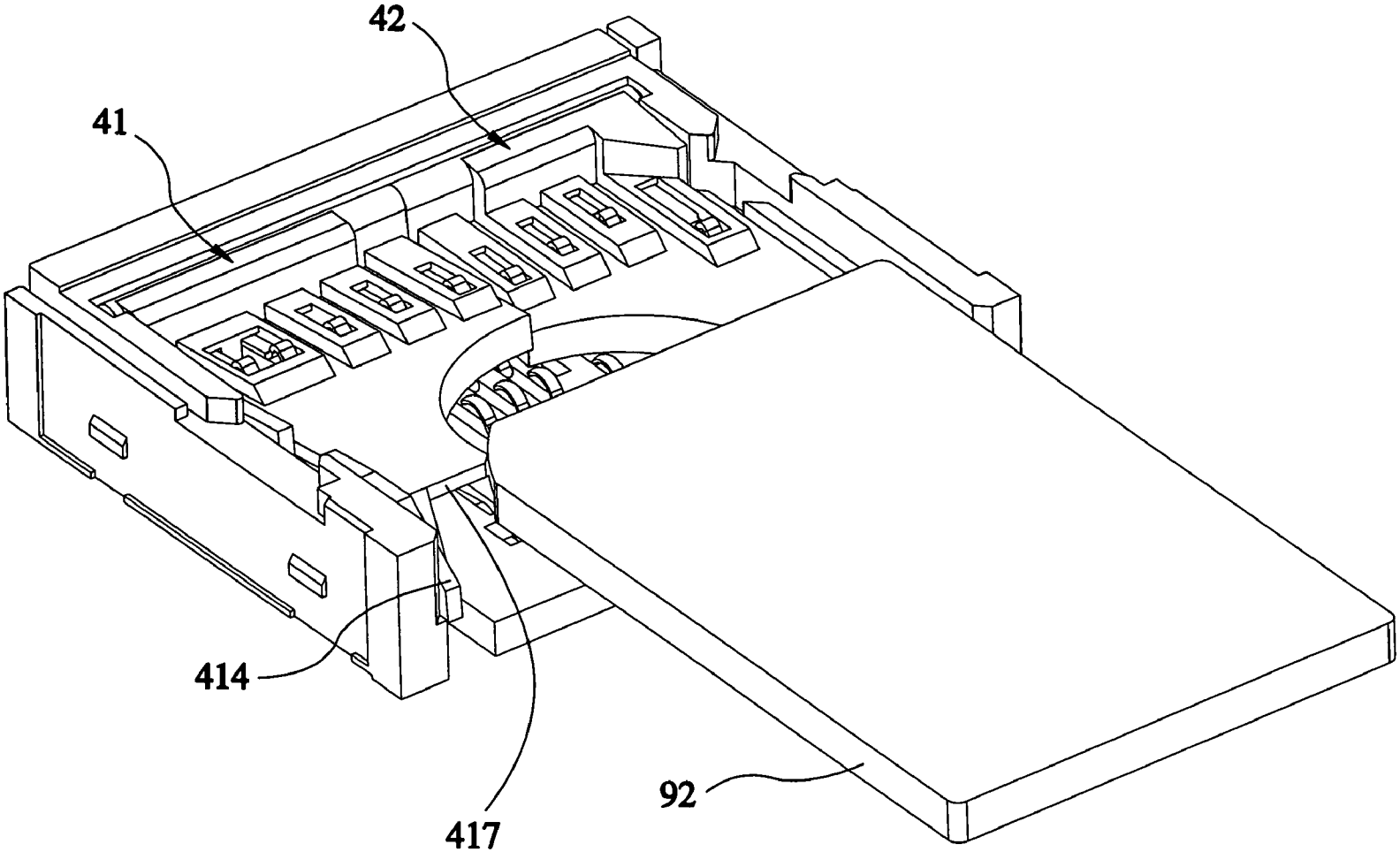
FIG. 11 is a schematic view of the preferred embodiment of the present invention in operation when another false action happens, illustrating that the MS-Duo card is stopped from entering the upper card slot.

Referring to FIG. 11, when the MS-Duo card 92 is inserted by leaning sideward, for example, rightward, the front edge of the MS-Duo card 92 though works on the right bevel 424 (FIG. 10) but fails to work on the left bevel 414, such that the right movable spacer 42 is forced to pivot downward and the left movable spacer 41 keeps at the original height.

Figure 12:
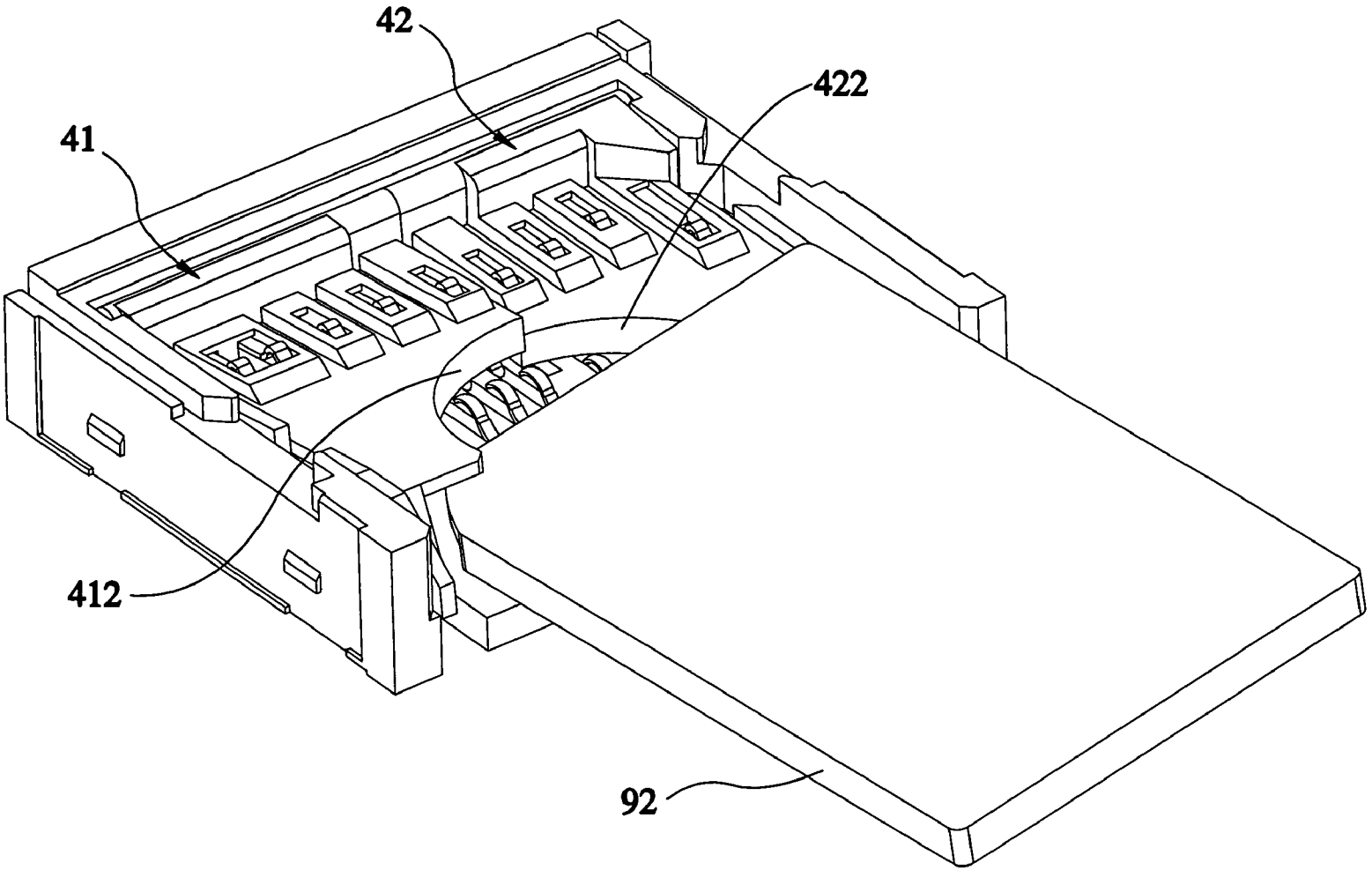
FIG. 12 is a schematic view of the preferred embodiment of the present invention in operation when another false action happens, illustrating that the MS-Duo card is stopped from entering the upper card slot.

Referring to FIG. 12, when the MS-Duo card 92 is being inserted on the skew, its front edge is located above the right movable spacer 42 and below the left movable spacer 41. During the forward movement of the MS-Duo card 92 toward the card chamber 22, the MS-Duo card 92 works on the left and right guide slopes 412 and 422 to enable the right movable spacer 42 to pivot downward and the left movable spacer 41 fails to pivot upward to remain still. Finally, the MS-Duo card 92 is stopped at the two guide slopes 411 and 412 from further entry because of the difference between the two movable spacers 41 and 42 in elevation.

In conclusion, the present invention comes up with the simple mechanism composed of two adjacent movable spacers for effectively allowing entry of only one single card at a time and avoiding multiple false actions of the card.

Although the present invention has been described with respect to a specific preferred embodiment thereof, it is no way limited to the details of the illustrated structures but changes and modifications may be made within the scope of the appended claims.

What is claimed is:

1. A card connector capable of avoiding multiple false actions of a card, comprising:

a base frame having at least two card slots formed therein;

a cover member mounted on said base frame, whereby a card chamber is formed between said cover member and said base frame and an entry is jointly defined by respective front ends of said cover member and said base frame;

a plurality of terminals mounted to said base frame and extending into said card chamber; and two movable spacers defined as a left movable spacer and a right movable spacer, said two movable spacers being pivotably attached to said base frame and located in said card chamber, said left movable spacer having a left guide slope extending slantingways rearward toward a center of said base frame from a front side thereof, said right movable spacer having a right guide slope extending slantingways rearward toward a center of said base frame from a front side thereof, said left movable spacer having a left bevel extending downward and forward from a left side of a front edge thereof, said right movable spacer having a right bevel extending downward and forward from a right side of the front edge thereof.

2. The card connector as defined in claim 1, wherein said terminals are divided into an upper terminal set and a lower terminal set, said lower terminal set being located below said two movable spacers, said upper terminal set being located above said lower terminal set and stopped against bottom sides of said two movable spacers, each of said terminals in said upper terminal set having a contact portion running upward through a bottom side and then a top side of one of said movable spacers to expose itself.

3. The card connector as defined in claim 1, wherein each of said two guide slopes comprises a guide bevel formed at a lower front edge thereof.

4. The card connector as defined in claim 1, wherein said two card slots are defined as an upper card slot and a lower card slot located on the upper card slot, said upper card slot corresponding to a relatively wider card, the lower card slot corresponding to a relatively narrower card.

5. The card connector as defined in claim 1, wherein said left movable spacer comprises a stopper formed at a front edge thereof and located at a left side of said guide slope, and said right movable spacer comprises a stopper formed at a front edge thereof and located at a right side of said guide slope.

6. The card connector as defined in claim 1, wherein said two movable spacers are pivotably attached to said base frame and their front edges slightly hike to be located at said upper card slot.

7. The card connector as defined in claim 6, wherein said base frame comprises two pivot cavities, and each of said two movable spacers comprises a pivot piece pivotably attached to one of said pivot cavities for pivoting movement on said pivot pieces.

8. The card connector as defined in claim 1, wherein said base frame comprises two hollow portions, each of which is located at one of two sides of said base frame; said left movable spacer comprises a left front arm formed at the front edge of the left side thereof and having a left bevel; said right movable spacer comprises a right front arm formed at the front edge of the right side thereof and having a right bevel; each of said left and right front arms corresponds to one of said two hollow portions.

9. The card connector as defined in claim 8, wherein each of said left and right front arms comprises an inclined guide portion at a side thereof, said two inclined guide portions facing each other.

* * * * *